US009885226B2

(12) United States Patent
Mazyar et al.

(10) Patent No.: US 9,885,226 B2
(45) Date of Patent: Feb. 6, 2018

(54) HEAT EXCHANGE IN DOWNHOLE APPARATUS USING CORE-SHELL NANOPARTICLES

(71) Applicants: Oleg A. Mazyar, Katy, TX (US); Bennett M. Richard, Kingwood, TX (US)

(72) Inventors: Oleg A. Mazyar, Katy, TX (US); Bennett M. Richard, Kingwood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 225 days.

(21) Appl. No.: 14/074,910

(22) Filed: Nov. 8, 2013

(65) Prior Publication Data

US 2015/0129221 A1 May 14, 2015

(51) Int. Cl.
*E21B 36/00* (2006.01)
*E21B 43/12* (2006.01)

(52) U.S. Cl.
CPC ..... *E21B 36/001* (2013.01); *E21B 43/128* (2013.01)

(58) Field of Classification Search
CPC ..... F28D 20/023; E21B 36/00; E21B 36/001
See application file for complete search history.

(56) References Cited

U.S. PATENT DOCUMENTS 4,807,696 A * 2/1989 Colvin ..... F28D 20/023 126/400
6,357,552 B1 * 3/2002 Eitler ..... E21B 43/121 166/68
7,029,514 B1 * 4/2006 Yang ..... B22F 1/0018 75/348
8,105,414 B2 * 1/2012 Zinn ..... B22F 1/0018 428/570
8,708,047 B2 * 4/2014 Chakraborty ..... C09K 8/03 166/302
8,840,803 B2 * 9/2014 Mazyar ..... E21B 43/128 165/104.11
8,991,498 B2 * 3/2015 Chakraborty ..... C09K 8/03 166/302
2007/0036951 A1 * 2/2007 Nguyen ..... C23C 18/1608 428/209

(Continued)

OTHER PUBLICATIONS

Sagoff, Jared; "New Nanoparticle Technology Cuts Water Use, Energy Costs," Argonne National Laboratory, Apr. 11, 2012, http://www.anl.gov/articles/new-nanoparticle-technology-cuts-watewr-use-energy-costs, pp. 1-3.

*Primary Examiner* — Angela M DiTrani
*Assistant Examiner* — Andrew H Sue-Ako
(74) *Attorney, Agent, or Firm* — Cantor Colburn LLP

(57) ABSTRACT

In one aspect, a method of extracting heat from a downhole device is disclosed, which method, in one non-limiting embodiment, may include: providing a heat exchange fluid that includes a base fluid and core-shell nanoparticles therein; circulating the heat exchange fluid in the downhole device proximate to a heat-generating element of the downhole to cause the core of the core-shell nanoparticles to melt to extract heat from the downhole device and then enabling the heat exchange fluid to cool down to cause the core of the core shell nanoparticles to solidify for recirculation of the heat exchange fluid proximate to the heat-generating element.

19 Claims, 5 Drawing Sheets

(56) References Cited

U.S. PATENT DOCUMENTS

| | | | | |
|---|---|---|---|---|
| 2009/0141585 | A1* | 6/2009 | Al-Otaibi | B01F 5/061 366/339 |
| 2010/0065616 | A1* | 3/2010 | Zinn | B22F 1/0018 228/249 |
| 2012/0032543 | A1* | 2/2012 | Chakraborty | B82Y 30/00 310/90 |
| 2013/0043028 | A1* | 2/2013 | Chakraborty | C09K 8/03 166/302 |
| 2013/0200299 | A1* | 8/2013 | Mazyar | E21B 43/128 252/75 |
| 2014/0000898 | A1* | 1/2014 | Chakraborty | C09K 8/03 166/302 |

* cited by examiner

HEAT EXCHANGE IN DOWNHOLE APPARATUS USING CORE-SHELL NANOPARTICLES

BACKGROUND

1. Field of the Disclosure

This disclosure relates generally to an apparatus and method for extracting heat from downhole devices and more particularly to extracting heat using core-shell nano particles.

2. Background of the Art

Wellbores are drilled in subsurface formations for the production of hydrocarbons (oil and gas). Wells often extend to depths of more than 1500 meters (about 15,000 ft.). Many such wellbores are deviated or horizontal. After a wellbore is formed, a casing is typically installed in the wellbore, which is perforated at hydrocarbon-bearing formation zones to allow the hydrocarbons to flow from the formation into the casing. A production string is typically installed inside the casing. The production string includes a variety of flow control devices and a production tubular that extends from the surface to each of the perforated zones. Some wellbores are not cased and in such cases the production string is installed in the open hole. Often, the pressure in the hydrocarbon-bearing subsurface formations is not sufficient to cause the hydrocarbons to flow from the formation to the surface via the production tubing. In such cases, one or more electrical submersible pumps (ESP) are deployed in the wellbore to lift the hydrocarbons from the production tubing to the surface. Power to the ESPs is supplied from the surface. Such pumps are often deployed at great depths, where the wellbore temperature can exceed 200° F. An ESP includes an electrical motor and a pump. The electrical motor includes magnets and windings, which generate heat. The temperature inside the motor of an ESP can often reach or exceed 300° C. ESP's are relatively expensive and can therefore also be prohibitively expensive to replace. It is therefore desirable to extract as much heat as practicable to reduce the temperature of the motor for efficient operation and the longevity of the motor. Other downhole devices and sensors also operate more efficiently and have longer operating lives at lower temperatures.

The disclosure herein provides apparatus and methods for removing or extracting heat from downhole devices including, but not limited to, electrical submersible pumps.

SUMMARY

In one aspect, a method of extracting heat from a downhole device that generates heat is disclosed, which method, in one non-limiting embodiment, may include: providing a heat exchange fluid that includes a base fluid and core-shell nano particles therein; circulating the heat exchange fluid in the downhole device proximate to a heat generating element to cause the cores of the core-shell nanoparticles to melt to extract heat from the downhole device and then enabling the heat exchange fluid to cool down to cause the cores of the core shell nanoparticles to solidify for recirculation of the heat exchange fluid proximate to the heat-generating member.

In another aspect, an apparatus for use in a wellbore is disclosed that in one non-limiting embodiment may include a downhole device that generates heat; a reservoir containing a heat exchange fluid having a base fluid and core-shell nanoparticles; a fluid circulation mechanism that circulates the heat exchange fluid in the downhole device to cause the cores of the core-shell nanoparticles to melt and then solidify before recirculating the fluid.

Examples of the more important features of the apparatus and methods of the disclosure have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements have generally been given like numerals and wherein.

DESCRIPTION OF EXEMPLARY EMBODIMENTS

Figure 1:
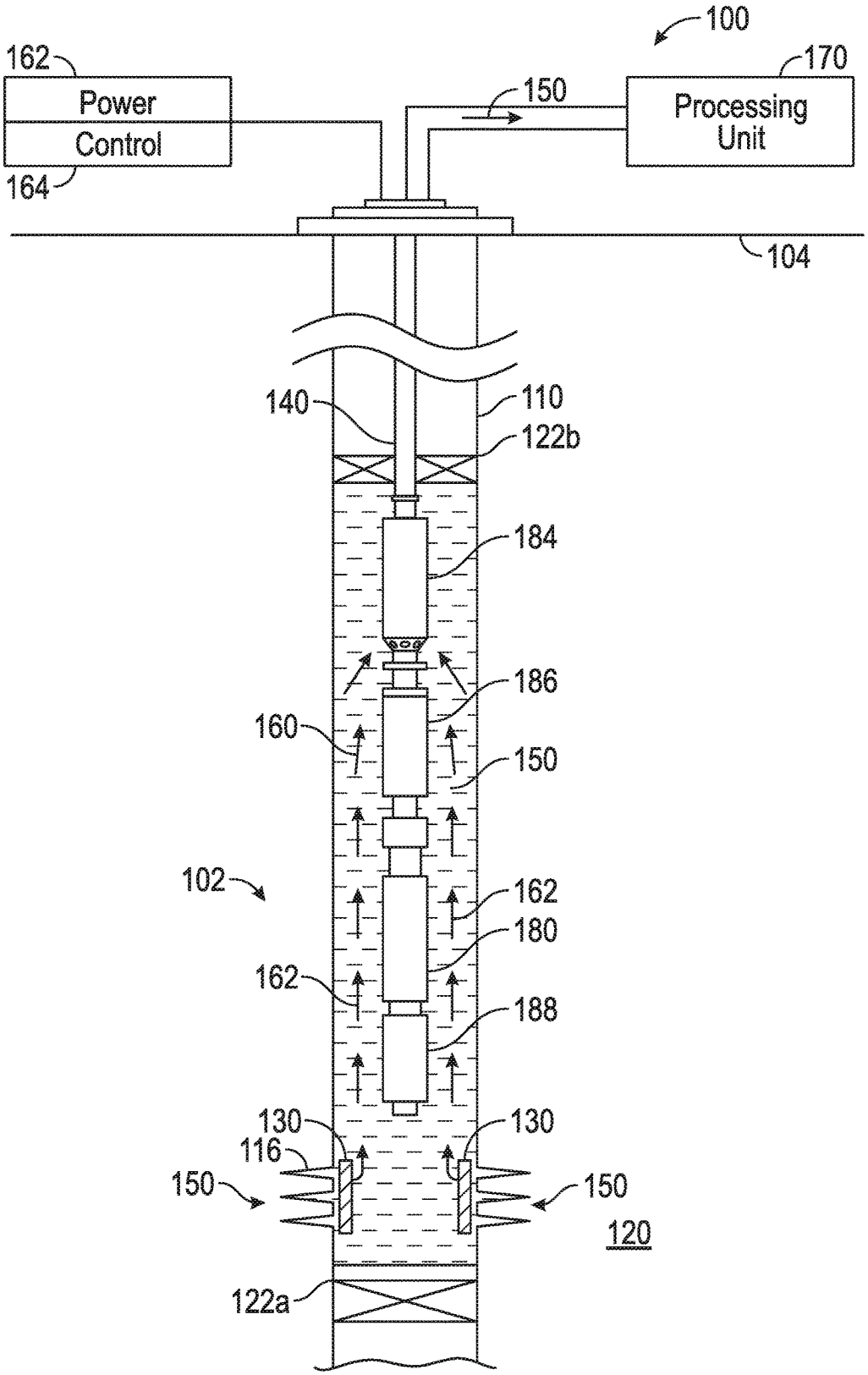
FIG. 1 is a schematic line diagram of an exemplary production wellbore with an ESP deployed therein, made according to one non-limiting embodiment of the disclosure, for lifting formation fluid to the surface.

FIG. 1 shows an exemplary wellbore system 100 that includes a wellbore 110 that has been drilled from the surface 104 through the earth formation 102. The wellbore 110 is shown formed through a production zone 120 that contains hydrocarbons (oil and/or gas) therein. The fluid in the production zone 120 may contain hydrocarbons (oil and/or gas) and water and is referred to herein as the formation fluid. The formation fluid 150 enters the wellbore 110 from the production zone 120 via perforations 116 and control equipment 130, such as sand screens, valves, etc. known in the art. The formation fluid 150 then enters a pump 184 of an electrical submersible pump (ESP) 160 as shown by arrows 162. The production zone 120 is shown isolated from the wellbore 110 above and below perforations 116 by packers 122*a* and 122*b*. The wellbore section between the packers 122*a* and 122*b* is therefore filed with the formation fluid 150. The ESP 160 is shown deployed on a production tubing 140 for lifting the formation fluid 150 from the production zone 120 to the surface 104 via the production tubing 140. The fluid level in the wellbore is maintained a certain level above the ESP to provide a fluid head to the ESP. Power to the ESP 160 is supplied from a power source 162 at the surface and a controller 164 controls the operations of the ESP 160. A fluid processor 170 at the surface 104 processes the formation fluid 150 received at the surface 104. In general, the ESP 160 includes an electric motor 180 that drives a pump 184 that moves the formation fluid 150 to the surface. Seals 186 separate the motor 180 and the pump 184. Various sensors 188 may be utilized for determining information about one or more parameters relating to the ESP 160, including, but not limited to, temperature, pressure and vibration. As noted earlier, the disclosure herein provides apparatus and methods for removing heat from devices using core-shell nanoparticles as heat transfer particles. As an example, and not as a limitation, the concepts and the methods for removing heat using core-shell nanoparticles are described herein in reference to ESPs, which are known to generate significant amounts of heat during operation in wellbores.

In one aspect, the heat transfer particles may be nanoparticles or micro-particles or a combination thereof. The term "nanoparticle" is used herein to denote particles having nano and micro sizes or a combination thereof. In a non-limiting embodiment, the nanoparticles include a core and a shell surrounding the core. In one aspect, the core may include a metallic material and the shell may be made from a metallic or a non-metallic material. In another aspect, the core may be bismuth and the shell made from a metallic or non-metallic material. In another embodiment, the core may be bismuth and the shell may be made from aluminum, alumina or a combination thereof. Bismuth has a melting point of 271.5° C. and density of 9.78 gm/cc at the room temperature. When solid bismuth is heated, it starts to store heat or thermal energy and its temperature rises up to its melting point. At the melting point, further introduction of heat increases the enthalpy of bismuth but its temperature remains constant until all the material has become liquid. This change in enthalpy is commonly referred to as the "enthalpy of fusion" or "heat of fusion". Once all of the bismuth has melted, further heating the liquid bismuth increases its temperature. Therefore, bismuth can be heated to a temperature above its melting point, for example 350° C., to store thermal energy, with the heat of fusion being a significant part of the total stored thermal energy. The melting point of aluminum or alumina is substantially higher than the melting point of bismuth and the steam temperature, thereby allowing the nanoparticles have bismuth as core to be heated to an elevated temperature to store thermal energy. In one aspect, the present disclosure utilizes the stored thermal energy to discharge heat to a selected section of the reservoir to decrease the viscosity of the fluids therein, such as heavy oils, typically present as bitumen.

In one aspect, the nanoparticles having a core and a shell may be made by heating nanoparticles of a core material, such as bismuth, with triethylaluminum. Triethylaluminum decomposes above 162° C., whereat the aluminum separates from the triethylaluminum compound. When the mixture of bismuth nanoparticles and triethylaluminum is heated between the decomposition temperature of triethylaluminum and melting point of bismuth, the aluminum separates from the triethylaluminum compound. The separated aluminum attaches to the bismuth nanoparticles forming a shell around the bismuth nanoparticles, thereby providing nanoparticles having a bismuth core and an aluminum shell. Oxygen present in the environment oxidizes at least some of the aluminum to alumina ($Al_2O_3$), thereby providing a shell that is a combination of aluminum and alumina. If the mixture is heated to just below the melting point of bismuth, it attains its maximum volume. And when the aluminum and/or alumina attaches to bismuth nanoparticles, the cores of such nanoparticles have the maximum volume. When such core-shell particles are cooled down, bismuth core shrinks while the aluminum/alumina shell shrinks, but less than the core. When such shell-core nanoparticles are heated to or above the melting point of bismuth, the core expands to its maximum volume within the shell until it melts and then shrinks a bit because the density of the molten bismuth (10.05 gms/cc at the melting point) is greater than the density of the solid bismuth (9.78 gms/cc at room temperature). After bismuth shrinks at the melting point, further heating of core starts the liquid bismuth core to expand. To prevent cracking of the shell due to the expansion of the molten core, the temperature is not exceeded beyond when the volume of the molten core becomes equal to the maximum volume of the solid core when the core was contained within the alumina/aluminum shell. Another embodiment of a phase change heat exchange particle may comprise a core made of a commercially known material referred to as "Polywax," which may include a polyethylene. The shell may comprise Nickel. In one aspect, a nanoparticle may include a Polywax core, formed as a sphere of polyethylene, and coated with a uniform layer of electroless Nickel shell. The coating or shell is continuous and porosity-free in order to confine the Polywax when it melts. Due to the difference in the thermal expansion coefficient of the Polywax core and the Nickel shell, the shell thickness is chosen to withstand the temperature oscillations during formation of the device containing such a material. This minimum thickness is a function of the thermal expansion coefficients and the mechanical properties of the core and the shell. Stress distribution calculation of the core (for example Polywax) and the shell (for example Nickel) may be used to determine the thickness of the shell. The dimensions of the Polywax-Nickel particles may exceed 2 microns. In addition to electroless deposition, the shell may be produced by Physical Vapor Deposition or Chemical Vapor Deposition processes and variations thereof. In such cases the particles can be suspended in a fluid bed or in a fluidized bed, or in a vibrating or rotating table, where they are free to rotate while the outer layer is deposited. Any suitable size of the heat exchange particles may be utilized for the purposes of this disclosure. As an example, core sizes between 1 nm and 40 nm and shell thickness of at least 0.3 nm may be utilized as heat exchange particles.

Figure 2:
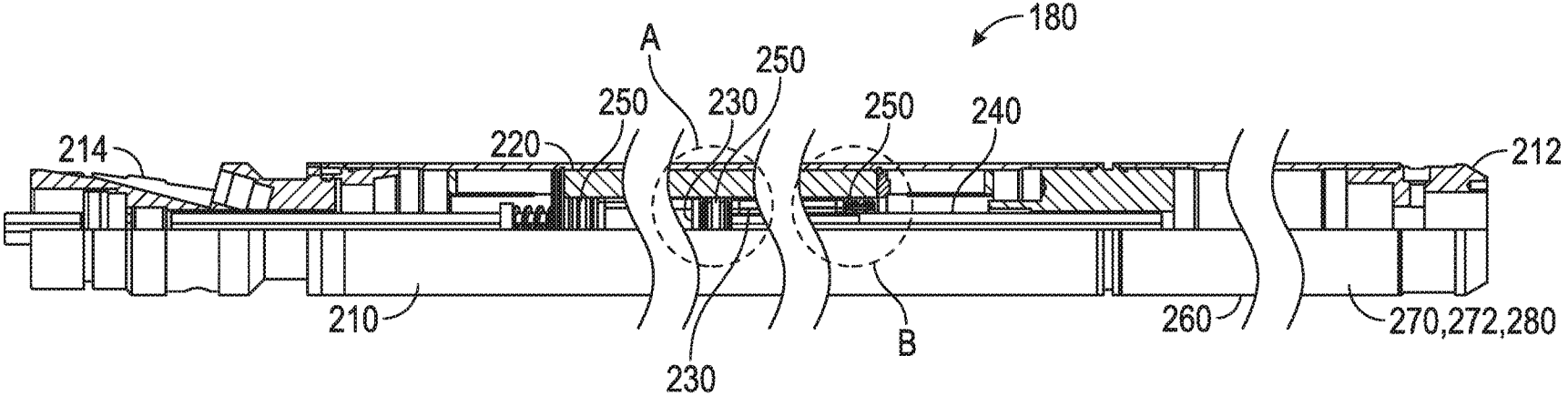
FIG. 2 shows a motor of an ESP that includes a heat exchange fluid according to one non-limiting embodiment of the disclosure.

FIG. 2 shows a motor 180 of an ESP that includes a heat exchange fluid according to one non-limiting embodiment of the disclosure. Referring to FIGS. 1 and 2, the motor 180 includes a housing 210, a base 212 and an upper threaded end 214 for connection to the seals 186. The motor 180 includes stator laminations 220 and rotors 230 that rotate a shaft 240. Bearings 250 support the rotors 230 and the shaft 240. The motor 180 further includes a heat exchange reservoir or chamber 260 that includes a heat exchange fluid 270. In one non-limiting embodiment, the heat exchange fluid 270 may include any fluid 272 used in ESPs and a selected amount of core-shell nanoparticles 280. During operations, the rotor 230 rotates the shaft 240 at a relatively high rotational speed, which speed may exceed 3000 rpm. The heat exchange fluid 270 moves up the shaft 240 and circulates around the bearings 250, thereby removing heat from the heat-generating elements, such as the stator laminations 220 and the rotor 230. Details of the heat removal process are described in more detail below in reference to FIGS. 3 and 4.

Figure 3:
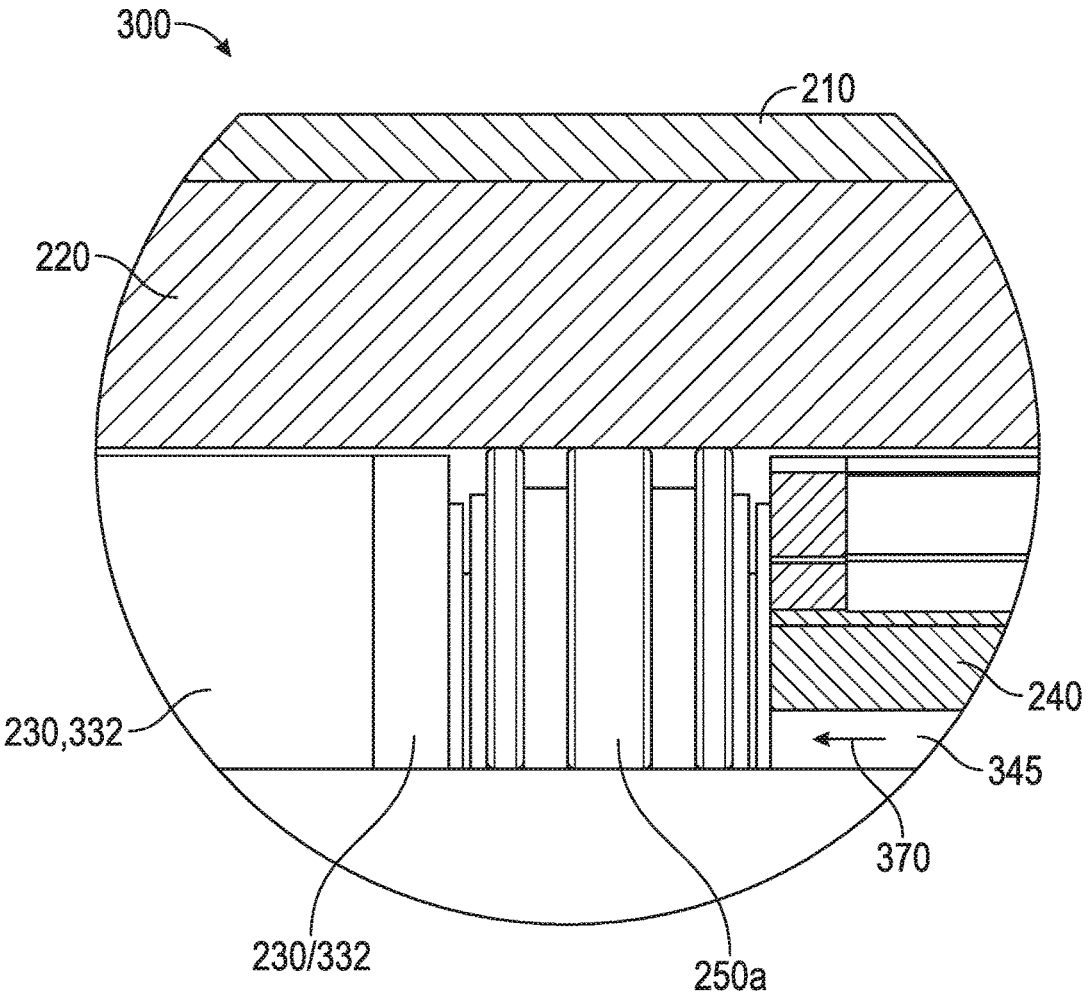
FIG. 3 shows a cut-view of the motor section "A" shown in FIG. 2.

FIG. 3 shows a cut-view 300 of motor section "A" shown in FIG. 2. View 300 shows the housing 210 containing stator laminations 220, rotor 230 with end rings 332, and shaft 240 supported by bearings 250*a*. A bore 345 runs along the shaft 240. The bore 345 is sufficient to allow the heat exchange fluid 270 to move from the heat exchange reservoir 260 up along the shaft 240, as shown by arrow 370, circulate around or proximate to bearings 250*a* and other heat-generating elements of the motor 180 and return back to the heat exchange reservoir 260 as described below in reference to FIG. 4.

Figure 4:
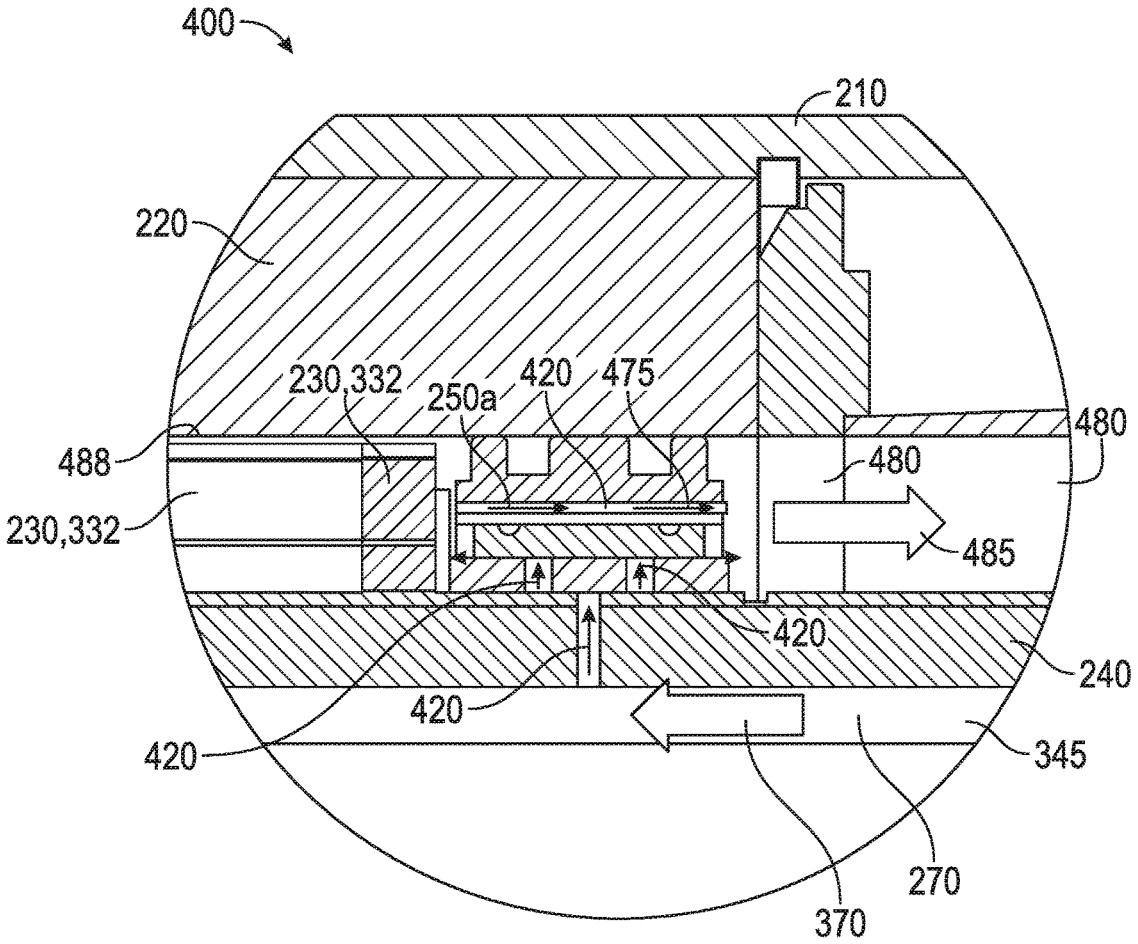
FIG. 4 shows a cut-view of the motor section "B" shown in FIG. 2.

FIG. 4 shows a cut-view 400 of motor section "B" shown in FIG. 2. View 400 shows housing 210 containing stator laminations 220, rotor 230 with end rings 332, and shaft 240 supported by bearings 250*a*. Heat exchange fluid 270 moving along the gap 345 is shown by arrow 370. The heat exchange fluid 270 moves from channel 345 and circulates around the bearing 250*a* via fluid passages 420 and returns to the reservoir 260 (FIG. 1) via fluid passages 420 and 480 as shown by arrows 475 and 485 respectively. Typically, there are more than one set of bearings. The heat exchange fluid 270 that is circulated around bearings that are above bearing 250*a* return to the reservoir 260 via a passage, such as passage 488.

In one aspect, the temperature around bearings 250 is greater than the melting point of the core of the core-shell nanoparticles 280 in the fluid 270. The cores of such nanoparticles 280 melt, i.e. undergo a first phase transition from a solid state to a liquid state, when they are in such high temperature environment. The nanoparticles 280 return to the reservoir 260, where they solidify, i.e. undergo a second phase transition, and recirculate as described above. The heat exchange system described herein is a closed loop system, in which the heat exchange fluid 270 containing the core-shell nanoparticles removes heat in excess of the heat that would have been removed by the base fluid 272 alone. In other aspects, the core of a nanoparticle may undergo other phase transitions to store and release energy, such as: transition from a crystal structure to amorphous structure; a transition from one allotrope of element to another allotrope; a peritectic transformation, in which a two-component single phase solid is heated and transforms into a solid phase and a liquid phase; eutectic transformation; a direct transition from a solid phase to a gas phase to a solid phase (sublimation/deposition); a transition to a mesophase between a solid and a liquid, such as one of the "liquid crystal" phase; etc.

Figure 5:
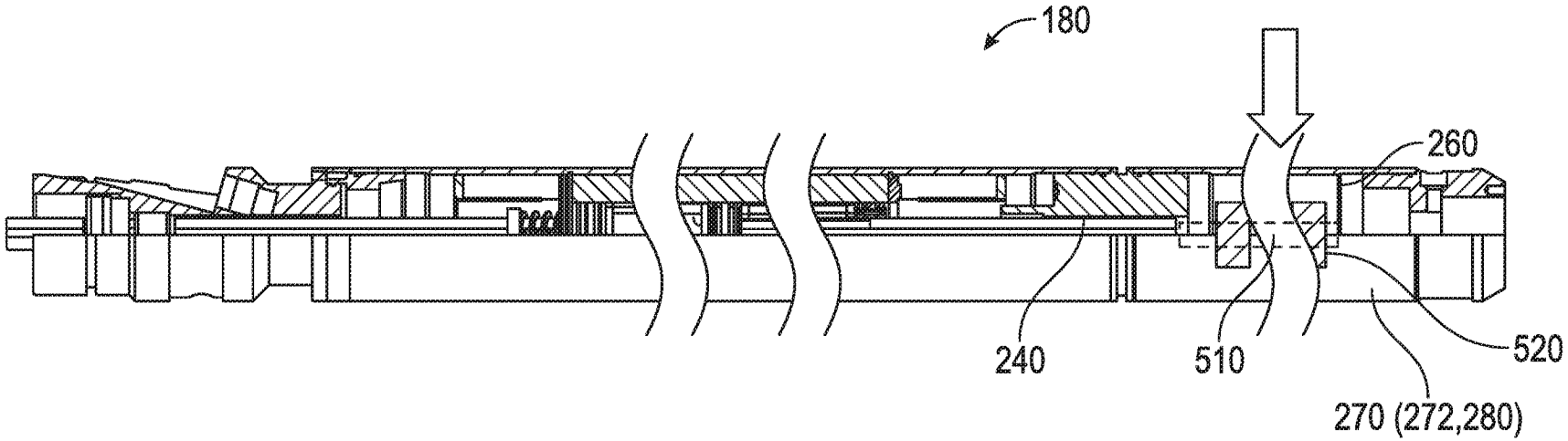
FIG. 5 shows a non-limiting embodiment of a heat-exchange fluid reservoir that includes or has associated therewith a device that mixes nanoparticles with a base fluid in the heat-exchange reservoir.

FIG. 5 shows a non-limiting embodiment of a reservoir that includes or has associated therewith a device that mixes the nanoparticles 280 with the base fluid 272 in the reservoir. In one aspect, the shaft 240 may be extended, as shown by extension 510 and a mixer 520 attached to the shaft extension 510. In one non-limiting embodiment, the mixer 520 may include any type of mixing mechanism, including, but not limited to, propellers and fins that continuously churn the fluid 270 in the reservoir 260.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of cooling a downhole device in a wellbore, the method comprising:

forming core-shell nanoparticles, denoting particles having nano and micro sizes or a combination thereof, wherein the core includes bismuth and the shell includes aluminum, by heating a mixture of the bismuth particles and triethylaluminum to a temperature just below the melting point of the cores and that maximizes the volume of the core, wherein the temperature that maximizes the volume of the core is about 271.4 degrees Celsius, wherein a core of the core-shell nanoparticles melts at a temperature below a temperature of the downhole device when the downhole device is in operation in the wellbore;

providing the downhole device with a heat exchange fluid that includes a base fluid and the core-shell nanoparticles;

operating the downhole device in the wellbore; and circulating the heat exchange fluid in the downhole device through a flow passage in a heat-generating element of the downhole device to cause the cores of the core-shell nanoparticles to melt to extract heat from the downhole device and then enabling the heat exchange fluid to cool down to cause the cores of the core-shell nanoparticles to solidify before recirculating the heat exchange fluid.

2. The method of claim 1, wherein the downhole device is an electrical submersible pump.

3. The method of claim 2, wherein the electrical submersible pump has a fluid reservoir configured to circulate in the electrical submersible pump and wherein providing the heat exchange fluid comprises filling the reservoir with the heat exchange fluid.

4. The method of claim 3, wherein temperature inside the electrical submersible pump is above the melting point of the core of the core-shell nanoparticles.

5. The method of claim 3 further comprising:

providing a fluid circulation mechanism inside the electrical submersible pump that causes the nanoparticles in the reservoir to circulate in the electrical submersible pump with the base fluid.

6. The method of claim 5, wherein the fluid circulation mechanism is operated by a rotating shaft in the electrical submersible pump.

7. The method of claim 1, wherein the core size is between 1 nm and 40 nm and thickness of the shell is at least 0.05 nm.

8. The method of claim 1, wherein the heat generating element is a bearing supported by a shaft and the heat exchange fluid flows through a flow passage in the shaft into the flow passage of the bearing.

9. The method of claim 1, wherein the aluminum shell is formed by heating a mixture of bismuth cores and triethylaluminum to a temperature above a decomposition temperature of triethylaluminum and below a melting point of bismuth.

10. A method of producing a fluid from a wellbore, the method comprising:

forming core-shell nanoparticles, denoting particles having nano and micro sizes or a combination thereof, wherein the core includes bismuth and the shell includes aluminum, by heating a mixture of bismuth particles and triethylaluminum to a temperature just below the melting point of the cores and that maximizes the volume of the core, wherein the temperature that maximizes the volume of the core is about 271.4 degrees Celsius, wherein a core of the core-shell nanoparticles melts at a temperature below a temperature of the downhole device when the downhole device is in operation in the wellbore;

deploying a production string in the wellbore, the production string including a downhole device that generates heat; and circulating a heat exchange fluid in the downhole device that includes a base fluid and the core-shell nanoparticles, wherein a core of the core-shell nanoparticles melts when circulated through a flow passage in a heat generating element of the downhole device to extract heat from the downhole device and then solidifies before recirculating proximate to the heat-generating element of the downhole device.

11. The method of claim 10, wherein the downhole device is an electrical submersible pump.

12. The method of claim 11, wherein the electrical submersible pump has a fluid reservoir configured to circulate the fluid in the electrical submersible pump and wherein providing the heat exchange fluid comprises filling the reservoir with the heat exchange fluid.

13. The method of claim 10 further comprising providing a fluid circulation device configured to circulate the heat exchange fluid in the downhole device.

14. An apparatus for use in a wellbore, comprising:

a downhole device that generates heat;

a reservoir containing a heat exchange fluid having a base fluid and core-shell nanoparticles denoting particles having nano and micro sizes or a combination thereof, wherein the core includes bismuth and the shell includes aluminum, wherein the core-shell nanoparticles are formed by heating a mixture of bismuth particles and triethylaluminum to a temperature just below the melting point of the cores and that maximizes the volume of the core, wherein the temperature that maximizes the volume of the core is about 271.4 degrees Celsius and the melting point of the cores is below a temperature of the downhole device when the downhole device is in operation in the wellbore; and a fluid circulation mechanism associated with the downhole device that circulates the heat exchange fluid through a flow passage in a heat generating element of the downhole device to cause the core of the core-shell nanoparticles to melt and then enables the melted core to solidify before recirculating the heat exchange fluid.

15. The apparatus of claim 14, wherein the downhole device is an electrical submersible pump.

16. The apparatus of claim 15, wherein the electrical submersible pump includes a fluid reservoir that contains the heat exchange fluid and the circulation mechanism includes a rotating shaft in the electrical submersible pump.

17. The apparatus of claim 15, wherein the circulation mechanism includes fins in a fluid reservoir containing the heat exchange fluid.

18. The apparatus of claim 14, wherein the core size is between 1 nm and 40 nm and thickness of the shell is at least 0.05 nm.

19. The apparatus of claim 14, wherein the heat exchange fluid includes a material that enables the core-shell nanoparticles to suspend in the base fluid.

* * * * *